US009555455B2

(12) United States Patent
Dauphinais

(10) Patent No.: US 9,555,455 B2
(45) Date of Patent: Jan. 31, 2017

(54) GUIDE WITH ADJUSTABLE NOSE CONE

(71) Applicant: SIEMENS INDUSTRY, INC., Alpharetta, GA (US)

(72) Inventor: Raymond P. Dauphinais, Marlborough, MA (US)

(73) Assignee: PRIMETALS TECHNOLOGIES USA LLC, Alpharetta, GA (US)

( * ) Notice: Subject to any disclaimer, the term of this patent is extended or adjusted under 35 U.S.C. 154(b) by 135 days.

(21) Appl. No.: 14/564,556

(22) Filed: Dec. 9, 2014

(65) Prior Publication Data

US 2015/0090827 A1 Apr. 2, 2015

Related U.S. Application Data

(62) Division of application No. 13/614,299, filed on Sep. 13, 2012, now abandoned.

(51) Int. Cl.

| | |
|---|---|
| ***B21C 47/04*** | (2006.01) |
| ***B65H 54/76*** | (2006.01) |
| ***B65H 57/02*** | (2006.01) |

(52) U.S. Cl.

CPC ..... *B21C 47/04* (2013.01); *B21C 47/045* (2013.01); *B65H 54/76* (2013.01); *B65H 57/02* (2013.01); *B65H 2701/36* (2013.01)

(58) Field of Classification Search

CPC ..... B21C 47/04; B21C 47/045; B21C 47/02; B21C 47/06; B21C 47/063; B21C 47/066; B21C 47/08; B21C 47/10; B21C 47/12; B21C 47/14; B21C 47/143; B21C 47/146

USPC ..... 242/360–363

See application file for complete search history.

(56) References Cited

U.S. PATENT DOCUMENTS

| | | | |
|---|---|---|---|
| 3,232,553 | A | 2/1966 | Kitselman |
| 4,437,620 | A | 3/1984 | Ozawa |
| 6,405,958 | B1 | 6/2002 | Behrens et al. |

FOREIGN PATENT DOCUMENTS

| | | | |
|---|---|---|---|
| JP | 01192674 | A | 8/1989 |

*Primary Examiner* — William E Dondero

(74) *Attorney, Agent, or Firm* — Gesmer Updegrove LLP

(57) ABSTRACT

A guide is adapted to be positioned for encirclement by a helical formation of rod rings free falling from the delivery end of a conveyor. The guide comprises a vertically projecting mandrel terminating at its upper end in a nose cone. The nose cone has a horizontal profile defined in part by at least one element having an outer edge separated by a variable radial distance from a central axis of the mandrel.

5 Claims, 3 Drawing Sheets

GUIDE WITH ADJUSTABLE NOSE CONE

PRIORITY

The present application is a divisional of U.S. application Ser. No. 13/,614,299, filed on Sep. 13, 2012, the contents of which are incorporated herein by reference in its entirety.

BACKGROUND

1. Field

Aspects of the present invention relate generally to rolling mills in which hot rolled steel rod is formed into a continuous series of rings, and the rings are deposited in an overlapping pattern on a conveyor where they undergo controlled cooling before being gathered into coils in a reforming chamber. Embodiments of the present invention further relate to a guide with an improved and adjustable nose cone adapted to be encircled by the rings as they free fall from the delivery end of the conveyor into the reforming chamber.

2. Description of Related Art

In a conventional rod rolling mill, as depicted diagrammatically in FIG. 6, rod is continuously hot rolled in a rolling mill, the last roll stand of which is shown at 10. The rod may then be preliminarily cooled in one or more water boxes 12 before being formed by a laying head 14 into a continuous series of rings "R" that are deposited in an overlapping pattern on a conveyor 16. After undergoing controlled cooling while being transported along the conveyor, the rings are allowed to free fall from the delivery end of the conveyor into a reforming chamber 18 where they are gathered into coils. The reforming chamber is typically provided with a centrally located guide comprising a vertically projecting mandrel positioned to be encircled by the free falling rings.

The upper end of the mandrel 20 is typically defined by a tapered nose cone 22 having a horizontal profile when viewed from above that is optimally configured and sized to accept and guide rings of a specific rod size. Experience has shown, however, that rings of differently sized rods act differently as they drop from the delivery end of the conveyor. Thus, a nose cone designed to handle one rod size may not be suitable for other rod sizes, the rings of which may not lay flat as they accumulate in the reforming chamber.

In the past, mill operators have sought to address this problem by employing multiple interchangeable nose cones, with each nose cone having a horizontal profile configured and sized to handle a specific rod size. The maintenance of multiple nose cones represents a significant capital investment, and the task of interchanging one nose cone for another is both time consuming and labor intensive.

SUMMARY

Broadly stated, embodiments of the present invention address the drawbacks of the prior art by providing a guide comprising a vertically projecting mandrel terminating at its upper end in a nose cone having a horizontal profile that can be changed to accommodate different rod sizes.

In exemplary embodiments of the present invention, the nose cone is defined by at least one element mounted to adjustably project outwardly from a central axis of said mandrel.

In an exemplary embodiment of the present invention, the nose cone comprises a plurality of angularly spaced fins extending radially from a central axis of the mandrel, with the horizontal profile of the nose cone being defined by outer edges of the fins, and with an adjustment mechanism for shifting at least one of the fins outwardly from the mandrel's central axis.

Preferably, at least one fin is shifted outwardly on the downstream side of the nose cone, i.e., in the direction of delivery of rings from the end of the conveyor.

These and other embodiments, features, objects and advantages of the present invention will become more apparent upon reading the following detailed description in conjunction with the accompanying drawings.

DETAILED DESCRIPTION

Figure 1:
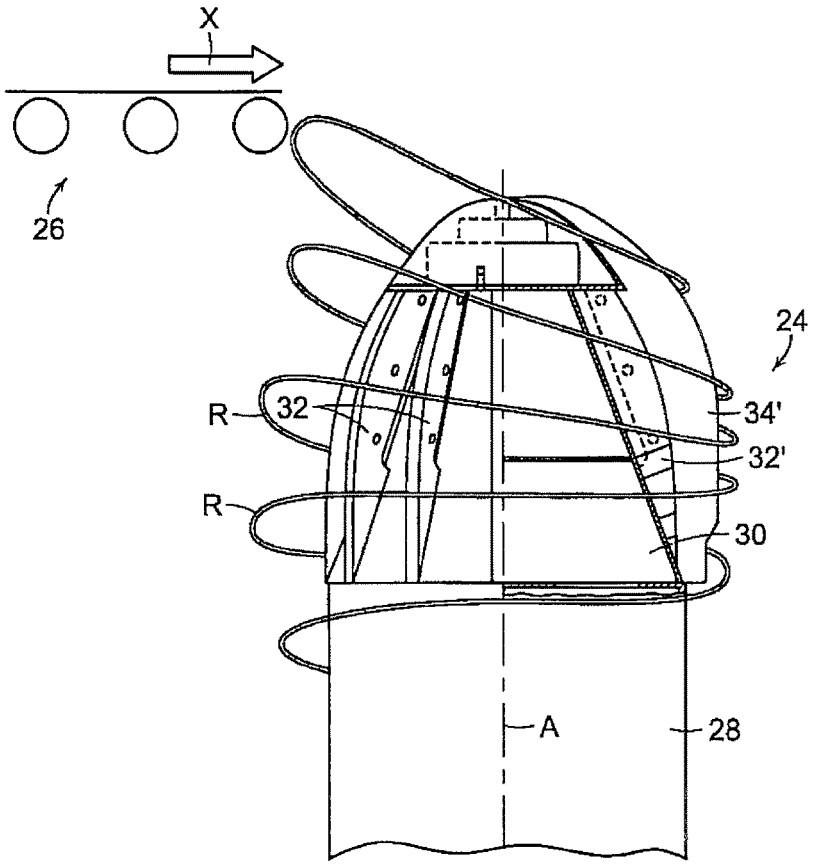
FIG. 1 is a side elevation view of a guide, in accordance with an exemplary embodiment of the present invention.

The components described hereinafter as making up the various embodiments are intended to be illustrative and not restrictive. Many suitable components that would perform the same or a similar function as well as the materials described herein are intended to be embraced within the scope of embodiments of the present invention.

Referring now to the figures, wherein like reference numerals represent like parts throughout the views, embodiments of the present invention will be described in detail.

Figure 2:
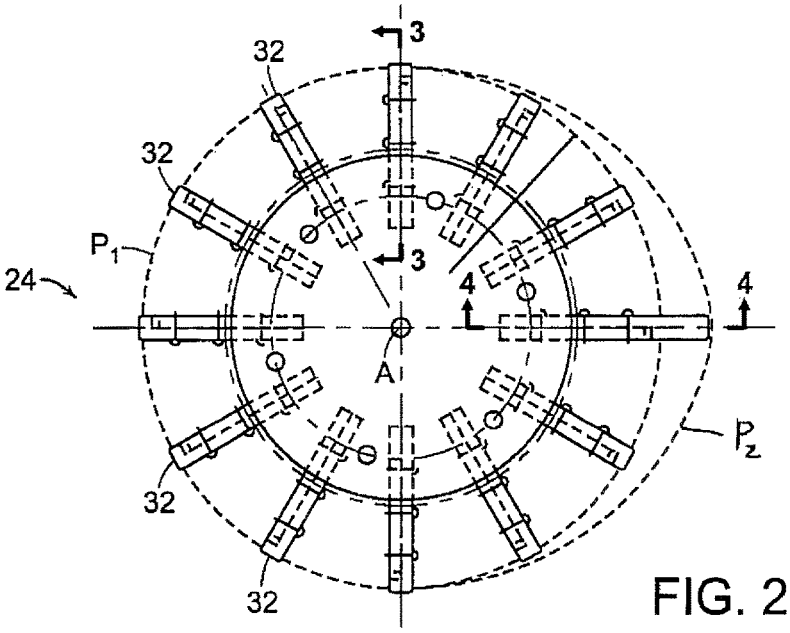
FIG. 2 is a plan view of the guide, in accordance with an exemplary embodiment of the present invention.

With reference to FIGS. 1 and 2, a guide 24 in accordance with an exemplary embodiment of the present invention is adapted to be positioned for encirclement by a helical formation of rod rings R free falling from the delivery end of a conveyor 26. The guide 24 comprises a vertically projecting mandrel 28 terminating at its upper end in a nose cone 30. The nose cone includes a plurality of angularly spaced elements, preferably in the form of fins 32, extending radially with respect to a central axis "A" of the mandrel 28.

Figure 3:
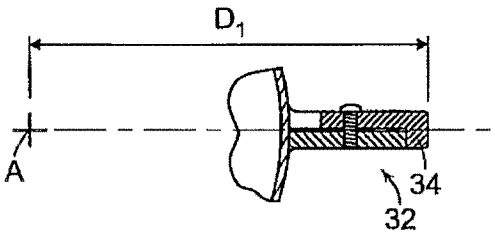

The fins 32 may be of the type depicted in FIG. 3, with rims 34 having outer edges separated by a radial distance $D_1$ from the mandrel's central axis A. If all the fins are identical, the resulting horizontal profile will be circular, as shown at $P_1$ in FIG. 2. Profile $P_1$ may be suitable for guiding rings of certain rod sizes, but may not be suitable for other rod sizes, which may require an enlarged profile.

Figure 4:
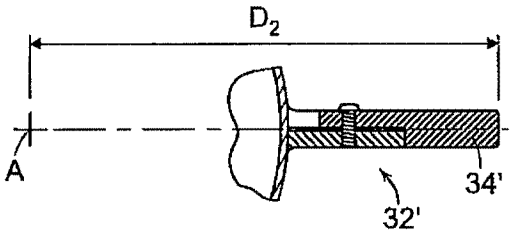
FIGS. 3 and 4 are sectional views taken respectively on lines 3-3 and 4-4 of FIG. 2.

In accordance with one aspect of the present invention, and in order to accommodate other rod sizes, the horizontal profile of the nose cone may be enlarged by projecting at least one of the fins outwardly from axis A to achieve the altered profile $P_2$ shown in FIG. 2. As shown in FIG. 4, this can be accomplished by providing one of the fins 32' with a radially enlarged rim 34' having an outer edge separated from the mandrel's central axis A by an increased radial distance $D_2$.

Figure 5:
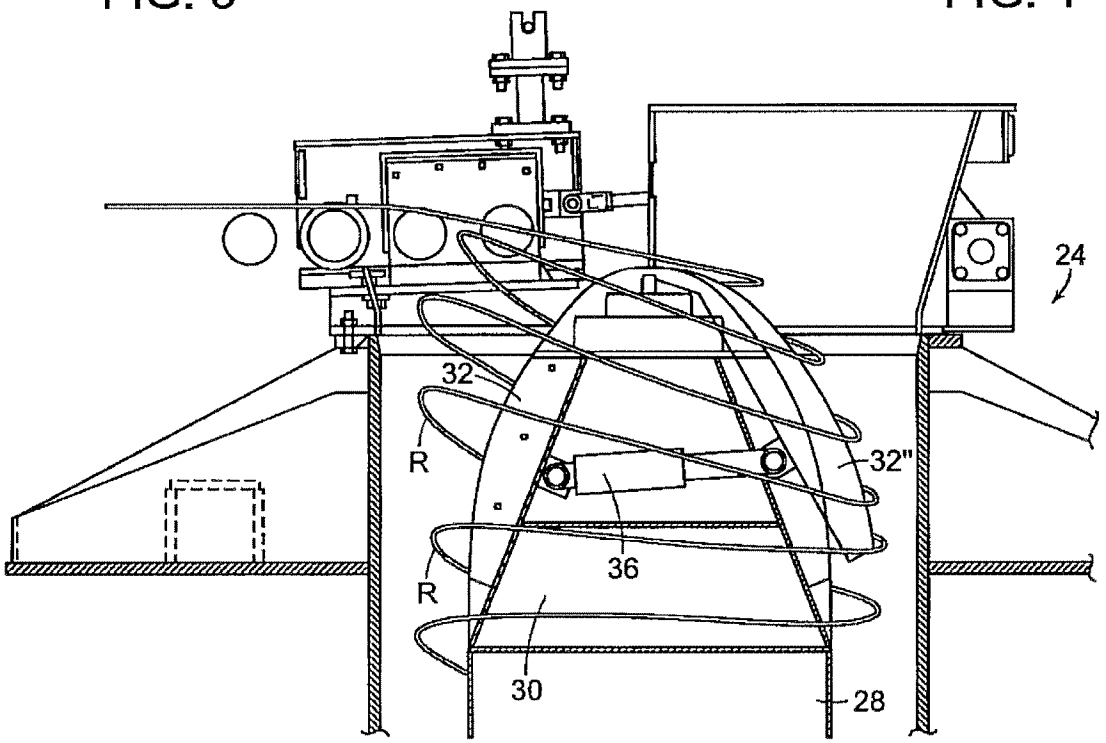
FIG. 5 is a side elevation view of a guide, in accordance with an alternative exemplary embodiment of the present invention.
Figure 6:
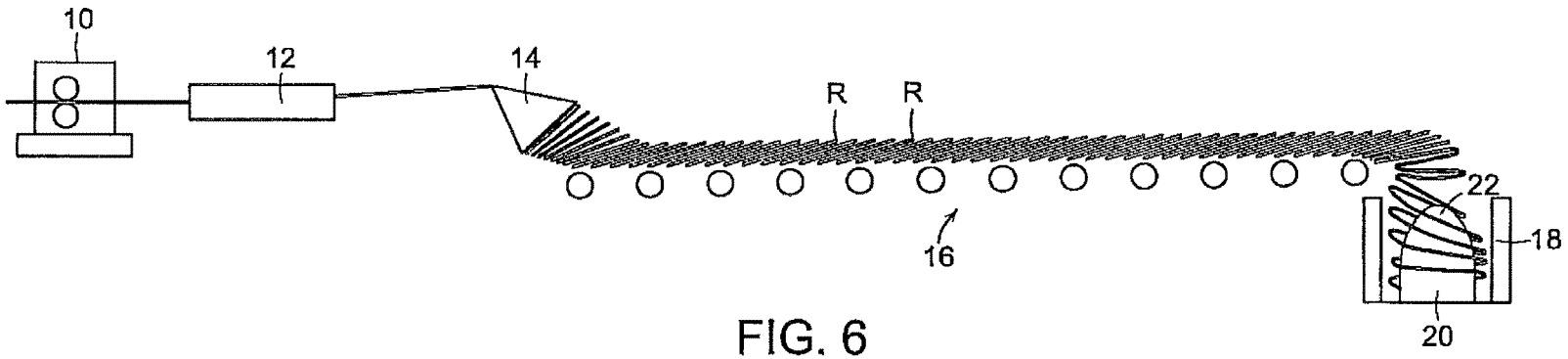
FIG. 6 (Prior Art)
FIG. 6 is a diagrammatic illustration of a portion of a conventional rolling mill.

Alternatively, as shown in FIG. 5, one of the fins 32" may be pivotally adjustable outwardly by means of a linear actuator 36. The linear actuator may be of many known types, for example and not limtation, hydraulically or pneumatically actuated piston/cylinder units, screw types, etc.

The nose cone's horizontal profile can be preferably enlarged on the downstream side of the nose cone, i.e. and as shown in FIG. 5, in the direction "X" of delivery of rings R from the conveyor 26.

With an exemplary embodiment of the present invention shown in FIGS. 1-4, enlargement of the nose cone's horizontal profile may be accomplished during down times of the mill when rings are not free falling from the conveyor 26. But in accordance with an exemplary embodiment of the present invention shown in FIG. 5, the horizontal profile of the nose cone 30 can be adjusted both during mill down times as well as when the mill is in operation and rings are free falling from the end of the conveyor 26 into the reforming chamber.

While exemplary embodiments of the invention have been disclosed, modifications, additions and deletions can be made without departing from the spirit and scope of the invention and its equivalents, as set forth in the following claims.

The invention claimed is:

1. A guide adapted to be positioned for encirclement by a helical formation of rod rings free falling from the delivery end of a conveyor, said guide comprising:

a vertically projecting mandrel terminating at its upper end in a nose cone, said nose cone being non-rotatable and having a horizontal profile when viewed from above defined by a plurality of angularly spaced elements, each of said elements having an outer edge separated by a radial distance from a central axis of said mandrel;

adjustment means for changing said horizontal profile by increasing the radial distance of at least one of the said elements;

and said at least one element is adjustably mounted on said nose cone, and wherein said adjustment means serves to shift said at least one element outwardly from a central axis of said mandrel.

2. The guide of claim 1 wherein said at least one element is located on a downstream side of said nose cone.

3. The guide of claim 1 wherein said adjustment means serves to enlarge said horizontal profile in the direction of delivery of rings from the end of said conveyor.

4. The guide of claim 1 wherein said at least one element is pivotally adjustable.

5. A guide adapted to be positioned for encirclement by a helical formation of product rings free falling from the delivery end of a conveyor, said guide comprising:

a vertically projecting mandrel having a non-rotatable nose cone at its upper end defined by plurality of angularly spaced fins extending radially from a central axis of said mandrel, said fins defining a horizontal profile as viewed from above; and adjustment means for enlarging said horizontal profile in the direction of delivery of rings from the end of said conveyor by shifting at least one of said fins outwardly from said central axis.

* * * * *